United States Patent [19]

Capella

[11] 4,453,470

[45] Jun. 12, 1984

[54] COLLAPSIBLE ARTIST'S EASEL

[76] Inventor: Sebastian Capella, 6383 La Jolla Scenic Dr. S., La Jolla, Calif. 92037

[21] Appl. No.: 347,169

[22] Filed: Feb. 9, 1982

[51] Int. Cl.[3] ..... A47B 97/04

[52] U.S. Cl. ..... 108/26; 248/460; 248/464

[58] Field of Search ..... 108/26; 248/460, 461, 248/463, 464

[56] References Cited

U.S. PATENT DOCUMENTS

| | | | |
|---|---|---|---|
| 2,982,568 | 5/1961 | Wolfe | 248/461 X |
| 3,145,966 | 8/1964 | Landon | 248/464 |
| 3,295,815 | 1/1967 | Howell | 248/464 |
| 3,926,398 | 12/1975 | Vincent | 248/460 |
| 4,057,215 | 11/1977 | Stettler | 248/460 |
| 4,109,892 | 8/1978 | Hartung | 248/464 |

FOREIGN PATENT DOCUMENTS

| | | | |
|---|---|---|---|
| 101712 | 5/1962 | Netherlands | 248/460 |
| 352142 | 7/1931 | United Kingdom | 248/460 |

*Primary Examiner*—William E. Lyddane
*Assistant Examiner*—Peter A. Aschenbrenner
*Attorney, Agent, or Firm*—Frank D. Gilliam

[57] ABSTRACT

A collapsible easel for use by an artist or the like. The easel comprises a lower and upper base, each having top, bottom and side members, a tripod leg is attached to the top member of the lower base, a platform is pivotly connected between the side members of the lower base including a pallete work surface and a covered storage compartment and a pair of translatable brackets carried by the side members of the lower base and translatable therealong; the brackets are pivotly connected to the bottom member of the upper base and pivotly connected to link members which are also pivotly connected to the platform. The upper base includes adjustable clamps for holding the medium on which the artist paints. Guides attached to the top member of the lower base fix the upper base member in rotational position and the guides are positionable for relocating the rotational position of the upper base. Locks are provided for locking the easel in a collapsed position and for locking the easel in an open operable position. In a collapsed position the top member of the upper base is positioned adjacent the bottom member of the lower base, the distal end of the tripod leg is adjacent thereto and the brackets are translated to a maximum position from the top member of the lower base. When deploying the easel from a collapsed to an open operable position, the lock is unlocked, the upper base is rotated substantially upright, the hinges are then translated downward causing the platform to rotate upward, forcing the tripod leg outward, when the brackets are fully translated downward adjacent the compartment, the device is locked in position and ready for use. Collapsing is done in a reverse manner.

14 Claims, 13 Drawing Figures

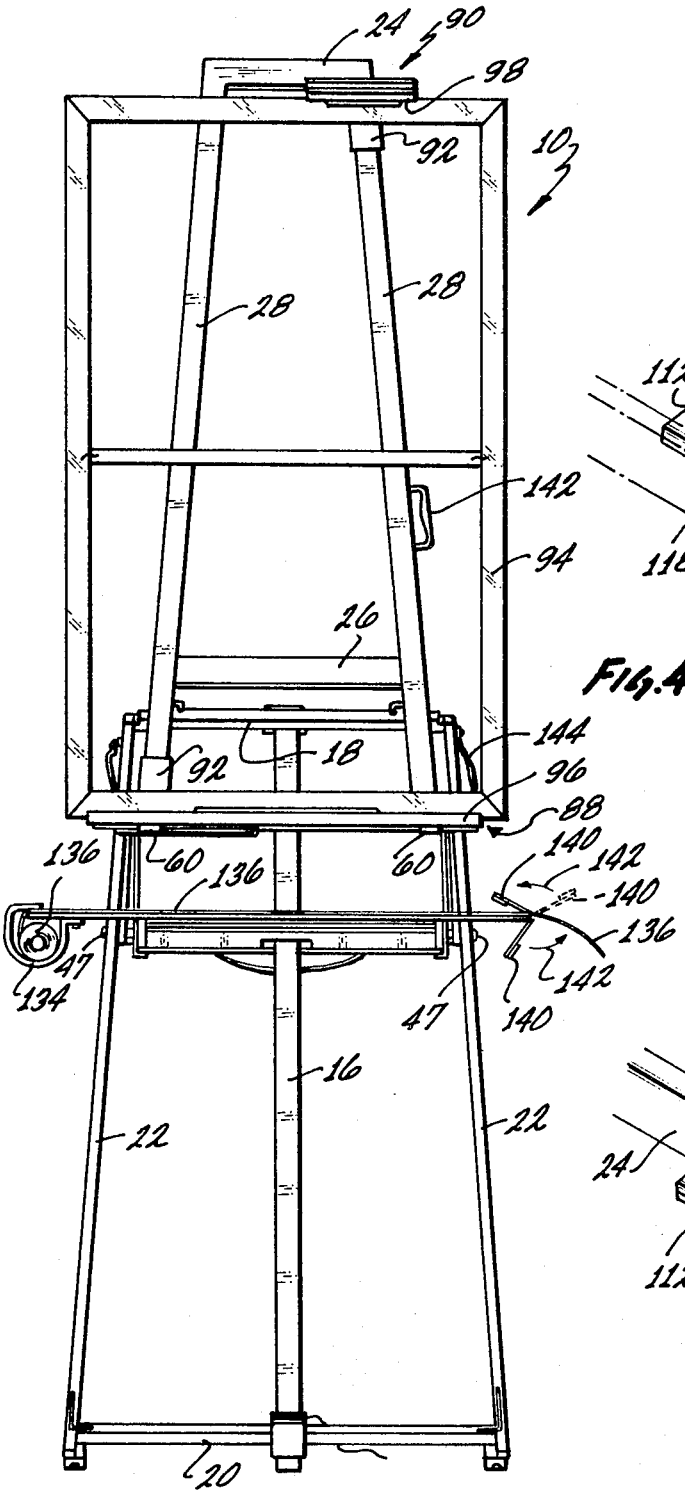
Fig. 4
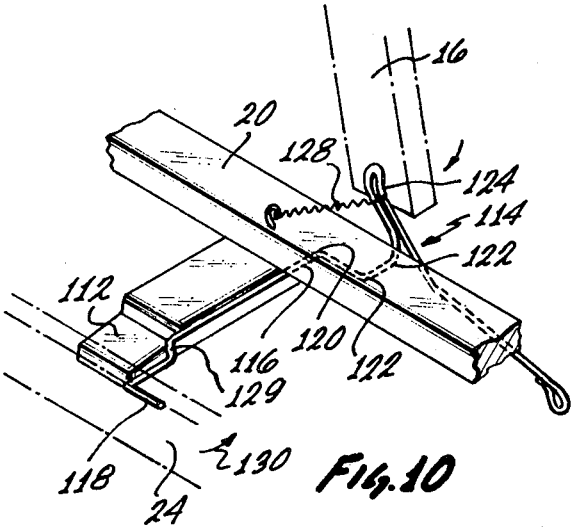
Fig. 10
Fig. 11
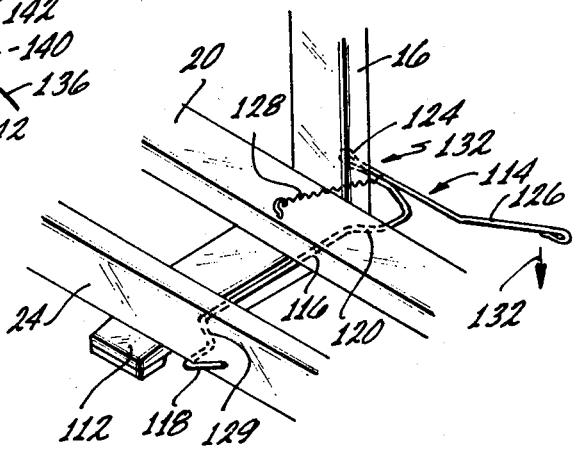

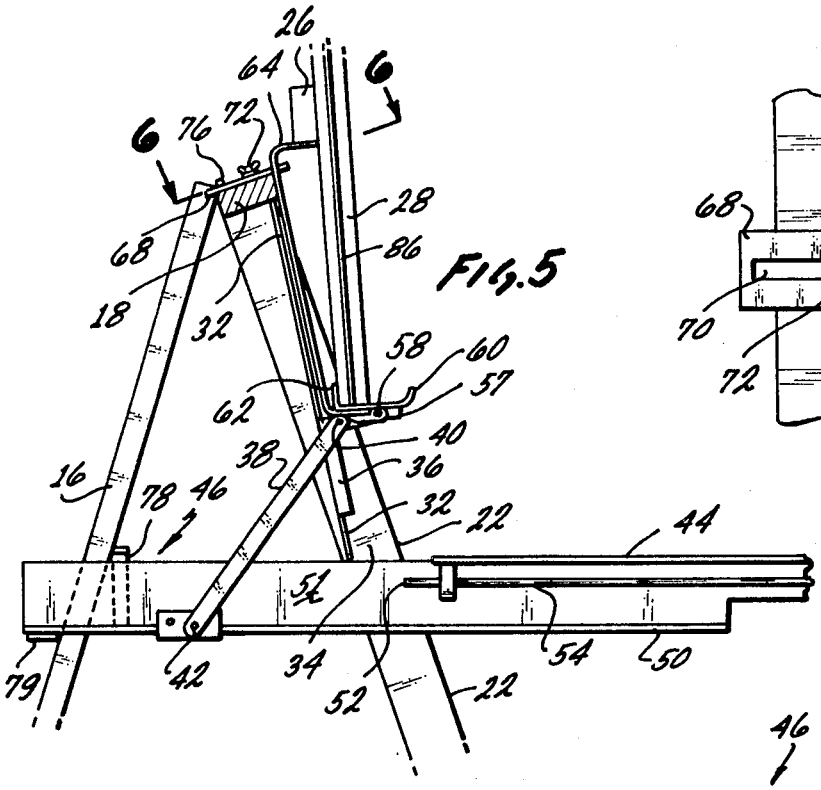
FIG. 5
FIG. 6
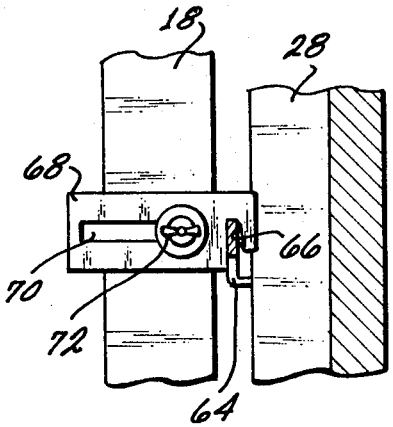
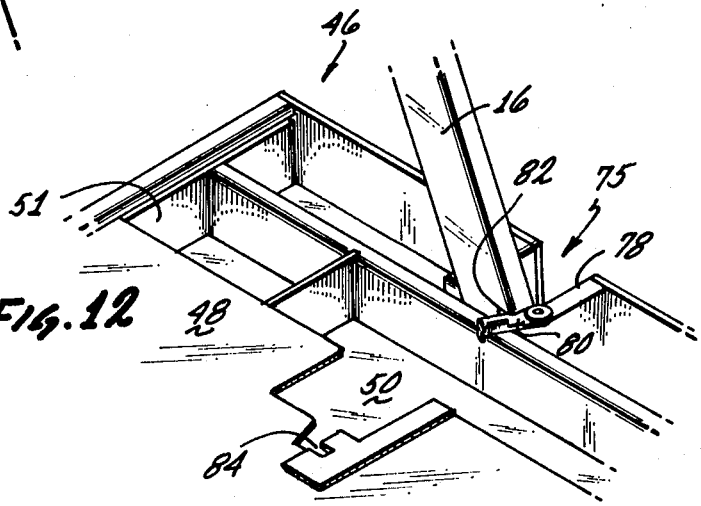
FIG. 12
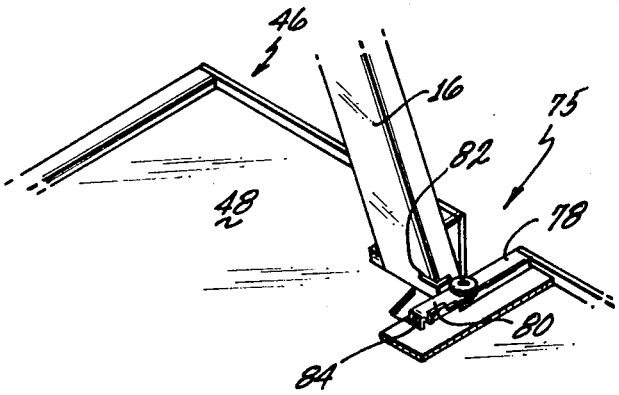
FIG. 13

COLLAPSIBLE ARTIST'S EASEL

BACKGROUND OF THE INVENTION

Conventional easels used by artists normally have a pair of rigid forward legs and one or more pivoted legs extending rearwardly therefrom, the forward legs having at least one horizontal supporting member thereon upon which the lower edge of a canvas or artist's board is supported. Examples of easels of this type are taught by U.S. Pat. Nos. 3,202,471; 2,953,341; 2,565,078 and 2,064,232. Easels of this type are highly successful for studio or semi-permanent locations but for the purposes of transporting or storing are awkward and consume a considerable amount of space both in relocation and in storage. As a result, attempts have been made to provide collapsible type easels. Obviously, the purpose of these collapsible easels is to render same as compact as possible when in a collapsed condition and, preferably, have no loose members to be accounted for when the easel is to be used or while being transported. Examples of collapsible easels are taught by U.S. Pat. Nos. 4,057,215; 3,244,450; 3,095,666; 3,095,665 and 2,549,306.

The principal problem associated with a collapsible easel is compactness, completeness as to essential features required by the artist, and size; that is, the easel must have size for the purposes intended.

SUMMARY OF THE INVENTION

The invention is directed to an easel for use by an artist and more particularly to an easel of full size and improved features which is collapsible into a small, compact unit for ease of transporting and storing.

The invention provides a collapsible easel in which the structure is relatively simple but strong and durable, as well as providing for minimum operations required to transform the easel from its compact collapsed condition to its open, operative, uncollapsed condition.

It is a principal object of this invention to provide a collapsible easel that has an upper and lower base, a leg pivotly attached to the upper surface of the lower base, a platform pivotly connected between the side members of the lower base, slidably engaging the leg and a pair of translatable hinges translatable along the sides of the lower base member. The hinges have a pivotable attachment to the upper base and pivotly attach to a pair of links which are pivotly attached at their opposite ends to the platform. This unique inter-connection of elements allows the easel, when in a collapsed position, to be transformed into a full-sized artists' easel with a minimum of movement. In its collapsed position, the easel has the top portion of the upper base positioned adjacent the lower portion of the lower base; the leg and platform are positioned parallel to the lower and upper base, and the hinges are translated to their outermost position adjacent the upper portion of the lower base member. To change the collapsed easel to an operable easel, the upper base is rotated away from the bottom portion of the lower base about the hinge pivotal connection to a position substantially perpendicular with the easel support surface. The hinges are then guided in a downward translation, causing the platform to rotate to a position substantially parallel with the easel support surface. The rotation of the platform is caused by the links attached between the platform and hinge. The slidable engagement between the platform and leg causes the leg to be pivoted outward away from the lower portion of the lower base with platform movement.

It is a further object of this invention to provide locking means for preventing the collapsing of the easel at an undesired time and to maintain the easel in a collapsed condition during movement thereof.

A further object of this invention is to provide a covered compartment for supplies such as paint and brushes, and to lock the cover in a closed position by the same locking means used to lock the easel in its operable position. The locking means locks the cover while unlocking the easel for collapsing and unlocks the cover when locking the easel in its open operable position.

A still further object of this invention is to selectively rotate the upper base toward or away from the artist, for positioning the medium on which the artist is painting to eliminate undesirable light reflection therefrom.

A still further objection of this invention is to provide a supply of throw-away palette means so that the artist can mix paints while painting and replace the pallete with a fresh one from a roll of impervious paper carried on the platform.

Still another object of this invention is to provide a canvas or artist board support means which is vertically adjustable to accommodate various sizes.

These and other objects and advantages of the invention will become better understood by reference to the following description. When considered with the drawings, in which:

BRIEF DESCRIPTION OF THE DRAWINGS

FIG. 4 is a front view of the collapsible easel in its FIG. 1 position;

FIG. 5 is an enlarged showing of a portion of FIG. 1 with the foreground side member of lower base removed for clarity;

FIG. 6 is a section of FIG. 5 taken along line 6—6;

FIG. 10 is a section of FIG. 1 taken along line 10—10, with the storage lock in an unlocked position;

FIG. 11 is a showing of FIG. 10 with the storage compartment lock in a locked position;

FIG. 12 is a section of FIG. 1 taken along line 12—12 showing the easel operable locking means in an easel locked open position and the compartment cover unlocked and partially open; and FIG. 13 is a showing of FIG. 12 with the easel operable locking means unlocked and the compartment cover closed and locked in position by the easel operable locking means.

DETAILED DESCRIPTION

Figures 1, 8, 9:
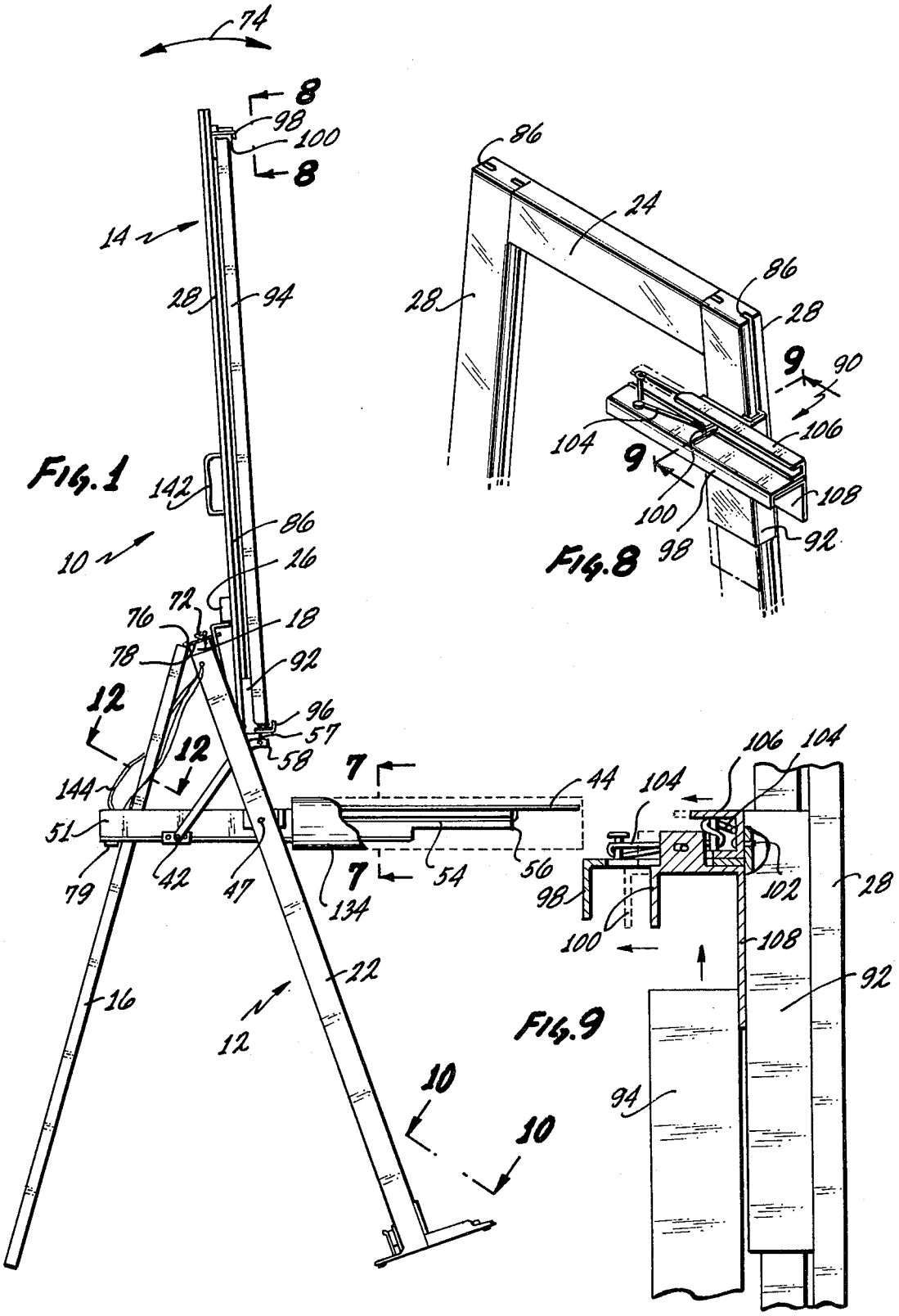
FIG. 1 is a side view of the collapsible easel of the invention shown in an uncollapsed open operable position.
FIG. 8 is a section of FIG. 1 taken along line 8—8.
FIG. 9 is a section of FIG. 8 taken along line 9—9.

Referring to FIGS. 1 and 4, the collapsible easel comprising the present invention is illustrated respectively in side and front views in an open operable uncollapsed position.

The easel 10 includes a lower and upper base 12,14 respectively and a tripod leg 16. The lower base is shown trapezoidal in plan view; however, various other configurations could be utilized to practice the invention. The lower base 12 includes top member 18, bottom member 20 and side members 22. The upper base 14, like the lower base, is shown trapezoidal in plan view and could, like the lower base, take many different forms. The upper base includes a top member 24, bottom member 26 and side members 28.

Referring now additionally to FIG. 5, a pair of hinge members 36 are carried by the lower base member 12. Each one of the pair of hinge members 36 is carried by and translatable along one of the lower base member side members 22. The side members 22 have a slot 32 along the inner surface thereof which carries lower portion of the hinge member 36. The lower portion is L-shaped in cross-section and in plain view. Pivotly attached to lower portion of the hinge 36 is a link 38. The link 38 to lower portion pivotal attachment 40 may be by way of screw, rivet or the like. The opposite end of the link 38 is pivotly attached at 42 to a combination platform 44 for supporting a palette or the like and a material storage compartment 46. The combination platform and compartment is pivotly attached at pivot pin 47 to each lower base side member 22.

Figure 7:
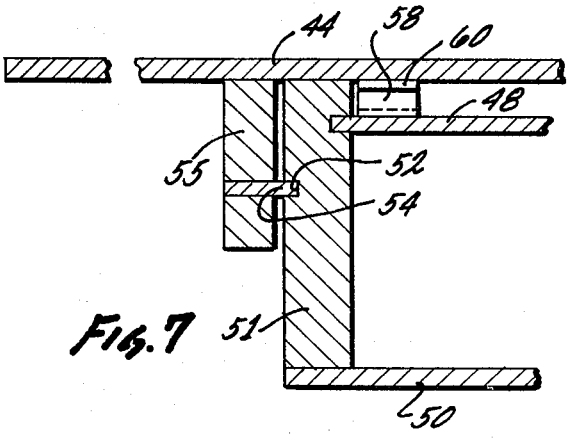
FIG. 7 is a section of FIG. 1 taken along line 7—7.

The compartment has a slidable lid 48 (see FIGS. 12 and 13) which selectively covers the compartment and a fixedly positioned botom closure 50. The side walls 51 of the compartment 46 each include a slotted guide means 52 which mates with inward directed key 54 of structural member 55 attached to platform 44 (also see FIG. 7). This allows translation of the platform 44 relative to the compartment so that complete access to the inner compartment 46 is possible. The slot extends to the end 56 of the side wall 51, allowing removal of the platform 44 as required. A pair of tabs 58 attached to lid 48 and a corresponding pair of tabs 60 attached to the lower side of platform 44 causes the lid 48 to translate toward a closed position when covered by the platform 44 so as to be accessible for further closing between its FIG. 12 and FIG. 13 positions.

The upper base is attached to the hinges 36 through a pair of brackets 57 which are pivotly connected to bracket 36 at pivot 58. The bracket 57 is fixedly attached to the ends of the upper base side members 28, which extend beyond the upper base bottom member 26. The bracket 55 has upwardly extending end surfaces 60,62. Attached to the bracket 57 and extending upward and outward therefrom are guide arms 64. The guide arms terminate at upper base bottom member 26 and attach either to the upper base bottom or side members. These guide arms 64 are confined within slot 66 of guide bracket 68 except when the hinged members 30 are translated to their extreme upward position for rotating the upper base 14 to its collapsed position as shown in FIG. 3. The guide arms 64 are substantially parallel with the side members 28 of the upper base and therefore are spaced further apart at their bracket 57 attachment than at their bottom member 26 attachment. This upward and inward slant allows the arm 64 to leave the slot 66 in their upward translation, thus allowing the upper base to rotate free of the brackets 57. When the hinges are again translated downward with the upper base in an upward rotated position as shown in FIG. 2, the guide arms 64 again align with slots 66 of the guide brackets 68. Brackets 68 are adjustable along slot 70 by the loosening of wing nut 72 and physically moving the bracket and retightening the wing nut 72. Both brackets should be length adjusted equally along slot 70 to allow smooth movement of the guide arms in their respective slots 66. The positioning of the guide brackets 68 allow selective positioning of the upper base in the direction of arrows 74 to the degree of movement allowed by the length of slot 70.

The leg 16 is pivotly attached to the top member 18 of the lower base by a hinge 76. Referring now specifically to FIG. 5, the leg 16 is confined between a compartment back wall 78 (shown in phantom) and a bottom plate 79. As will be described in more detail under the operation section, the pivoting of the platform 46 causes the leg to move between its FIG. 1 and FIG. 3 positions.

Referring now specifically to FIGS. 5, 12 and 13, FIG. 5, as discussed, shows a side view of the platform 44 slightly translated to the right side of the drawing. FIGS. 12 and 13 more clearly show the compartment 46 and lid 48. Also shown in FIGS. 12 and 13 is the rear compartment opening 75 through which the leg 16 is positioned. Located on the top surface of a side wall 78 is a rotatable lock arm 80 which when rotated into slot 82 in leg 16 locks the easel in its FIG. 1 position and unlocks the lid 48 of the compartment 46 allowing it to be translatable and when rotated out of slot 82 when lid 48 is in a compartment-closed position engages slot 84 in the lid, locking the lid in place and freeing the leg 16 for collapsing movement. As shown in FIG. 12, the compartment interior may have upright portions for forming small compartments for a variety of different articles.

Referring now specifically to FIGS. 1, 2, 4, 8 and 9, along the side members 28 of the upper base 14 is a slot 86 for receiving a bracket 88 on one side member and a bracket 90 on the other side member. The brackets 88 and 90 are operably similar, the significant difference being that bracket 88 is sufficient in length to span the distance between side members 28 at their greatest separation distance. Each of the brackets include a guide portion 92 which engages slot 86, allowing brackets 88,90 captive travel along their appropriate side members 28. The brackets 88,90 are used to position and hold the medium on which the artist paints, such as canvas, held in place by a frame 94. Other mediums may be held equally as well between the brackets 88,90. The brackets 88,90 each have a cross-member 96,98 respectively for securing the medium to be painted therebetween. Each cross-member 96,98 includes a translatable gripping wall 100 for gripping the lower and upper surfaces respectively of the medium for receiving artist's paint. In addition, the brackets 88,90 each have a translatable locking pin 102 which has a pointed distal end for engaging upper base side members 28 for locking the brackets 88,90 in a selected location. A single spring bias 104 bears against the translatable locking pin 102 carrying bracket 106 against gripping wall 100. It should be understood that guide portion 92 of brackets 88,90 may be angled from a ninety degree relationship to maintain cross-members 96,98 in a parallel relationship with the platform and supporting surface. For adjusting the correct location of brackets 88,90 to accommodate a given-sized framed canvas or the like, pin carrying brackets 106 are manually moved away from side members 28, releasing pin 102 from engagement with the side member and increasing the distance between gripping wall 100 and back surface 108. The framed canvas or the like 94 is then inserted between the brackets 88,90 and brackets 106 are released, allowing the spring 104 to cause locking pin 102 to again engage side wall 28 and force gripping wall 100 against the framed canvas or the like 94. The frame 94 is thusly held in place on the upper base until removed.

Referring now to FIGS. 10,11, a locking mechanism is included that simultaneously locks or unlocks leg 16 and top member 24 of upper base 14 to the lower base in the easel collapsed configuration as shown in FIG. 3. The locking mechanism comprises a foot member 110 extending away from the lower base bottom member 24 in a direction opposite to the leg 16 side. The foot member 110 includes a cutout 112 positioned on the distal end thereof. An actuating lever 114 is pivotly attached thereto at two locations 116. The lever 114 has an upward formed end 118 adjacent cutout 112, a dog leg bend 120, a substantially ninety degree bend at two places 122, a leg retaining double bend 124 and an extension 126. A spring 128 is interconnected between the double bend 124 and the lower base bottom member 20. FIG. 10 depicts an unlocked condition of locking lever 114 and FIG. 11 depicts a locked condition. In operation, the leg 16 is folded toward bottom member 20 post double bend 124 and against bottom member 20. Simultaneously or slightly thereafter in sequence, the upper base top member 24 approaches cutout 112 and as it is forced inward against lever 114 abutting formed portion 129 translating the lever 114 against spring bias along arrow 130 until bend 120 frees the back surface of bottom member 20, causing the spring to then rotate the lever about arrow 132, locking top member 24 and leg 16 in place as shown in FIG. 11. Forcing lever 114 downward in the direction of arrow 132 unlocks the top member and leg and the spring again translates lever 114 against arrow 130 to a FIG. 10 unlocked position.

Referring now specifically to FIG. 4, it may be desirable to provide a throw-away palette integral with the collapsible easel. An easel in the form of a roll of impervious material, such as, for example, butcher paper or the like, may be attached to the platform 44 in a manner depicted in the referenced figure. Attached to one outer surface of platform 44 is a palette roll carrier 134 which contains a roll of impervious palette material 136. The opposite side of the platform has a knife blade 138 which trims the palette material when drawn from the roll across the platform. A lock lever 140 is then rotated along arrow 142 through an opening in the knife blade, through the palette material and into a slot (not shown) in the platform, thereby locking the palette material to the platform. The roll carrier side of the platform may have a similar locking system (not shown) or the roll may be spring loaded in the container to bias against a single locking system provided by line 140. A handle 142 is attached to one side member 28 of the upper base for ease of handling while the easel is in a FIG. 3 collapsed condition. There is additionally provided a shoulder strap 144 constructed of any suitable material to provide hands-free carrying of the collapsed easel.

The collapsible easel may be constructed from any suitable material, by way of example and not limitation, wood, metal, plastic and the like, or any combination thereof suitable for the purpose intended.

COLLAPSING OPERATION

Figure 2:
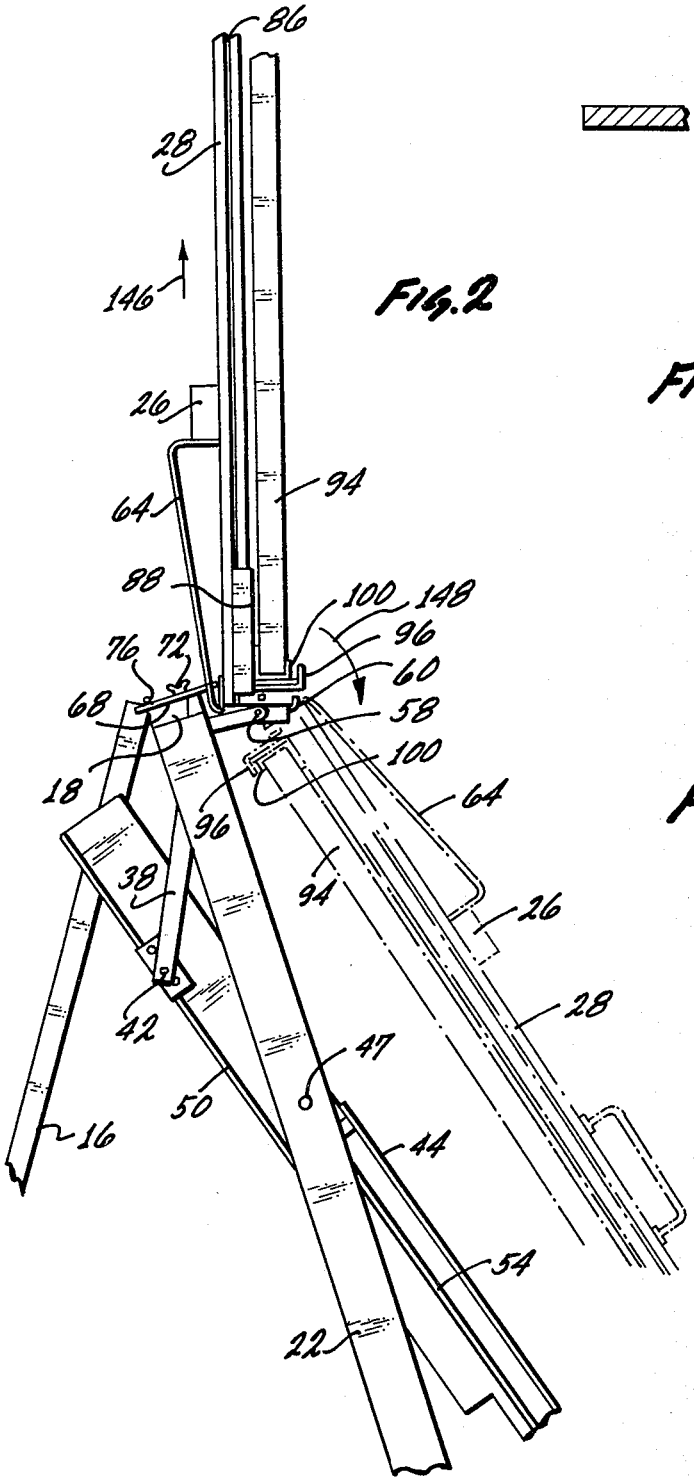
FIG. 2 is a side view of the collapsible easel in a partially collapsed position.
Figure 3:
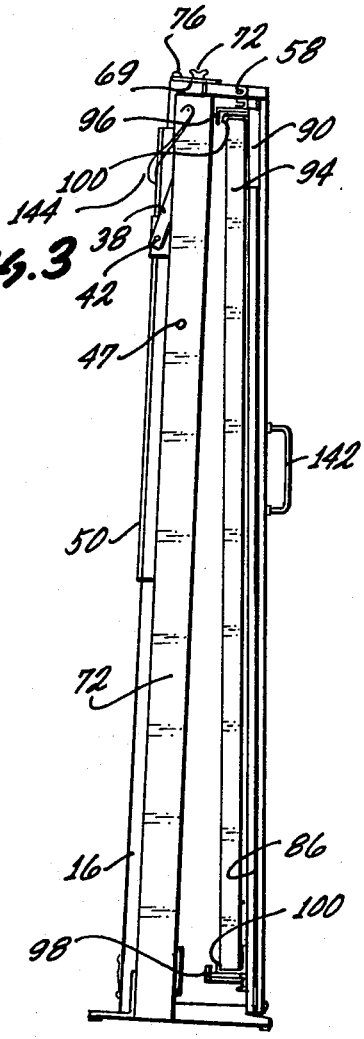
FIG. 3 is a side view of the collapsible easel in a fully collapsed position.

Referring now to FIGS. 1, 2 and 3, the easel in FIG. 1 is shown fully open and operable. First ensure that lever 80 is in its FIG. 13 unlocked leg/locked lid position; then pull the upper base 14 along arrow 146, beyond the FIG. 2 showing, until the guide arms 64 exit the slot 66 of bracket 68; and then rotate the upper base along arrow 148, which through links 38 rotate the front outer end of the platform/storage compartment combination downward, which fixes leg 16 captive in opening 75 toward the bottom member of the lower base member; this rotation is continued until lever lock 114 locks both the leg and top member of the upper base in the FIG. 3 position. To open the easel from the FIG. 3 configuration, the lever lock is released, allowing free rotational movement of the upper base and the leg and the reverse rotation and translative actions are performed, and the lever lock 80 then is manually moved to lock the leg in position and unlock the compartment lid.

The foregoing description illustrates a preferred embodiment of the invention. The concepts employed may, based upon the description, be employed in other embodiments without departing from the scope of the invention. Accordingly, the following claims are intended to protect the invention broadly, as well as in the specific forms show herein.

I claim:

1. A collapsible easel for use by an artist comprising in combination;

an upper and lower base each having a top member, a bottom member and a pair of side members;

a leg pivotly attached to the top member of the lower base; and a pair of translatable hinge members carried by and translatable along the pair of side members of the lower base and pivotly connected to the bottom member of the upper base, the hinge members translatable between an easel collapsed position adjacent the top member of the lower base member and an easel operable position spaced away from the top member of the lower base member toward the bottom member of the lower base.

2. The invention as defined in claim 1 wherein said collapsible easel further comprises a platform having a captive sliding engagement with said leg, a pivotal attachment to said lower base and a pivotal attachment to one end of a pair of links, the opposite end of each one of said pair of links being pivotly attached to a different one of said translatable hinges whereby when said translatable hinge members are translated to their easel collapsed position from their easel operable position, said platform member is caused to pivot to a position substantially parallel with said sides of said lower base and said leg is caused to pivot inward to a position substantially parallel with said sides of said lower base by the pivoting action of said platform member and, said upper base is pivoted about said translatable hinge members so that said top member of said upper base is adjacent the bottom member of said lower base.

3. The invention as defined in claim 2 additionally comprising a first locking means for locking said easel in a collapsed condition.

4. The invention as defined in claim 3 additionally comprising a second locking means carried by said platform for selectively engaging said leg for locking said easel in an operable non-collapsed position.

5. The invention as defined in claim 1 wherein said upper base includes an upper and lower supporting means for supporting the medium on which an artist paints.

6. The invention as defined in claim 2 wherein said upper base includes an upper and lower supporting means for supporting the medium on which an artist paints.

7. The invention as defined in claims 5 or 6 wherein said upper and lower supporting means are independently adjustable along at least one side member of said upper base to accommodate different vertically sized said medium on which an artist paints.

8. The invention as defined in claims 1 or 2 wherein guide means carried by the top member of the lower base member guide the translation of said pair of hinge members and preventing rotational movement of said upper base relative to said lower base, when said easel is in an open operable condition.

9. The invention as defined in claim 4 wherein said platform comprises a work table and a storage compartment with a slideable cover thereover and said second locking means locks said slideable cover in a fixed closed position when in its easel locked position and allows the sliding of said sliding cover to an open position, allowing access to at least a portion of said storage compartment, when said second locking means is in its easel operable position.

10. The invention as defined in claim 1 or 2 wherein strap means with one end fixedly secured and the opposite end removably connected between said lower base side members for transporting said easel in a collapsed condition.

11. The invention as defined in claim 8 wherein said guide means are selectively positionable for rotatable positioning the top member of said upper base at a selective location relative to a plane perpendicular with the easel's supporting surface.

12. The invention as defined in claim 9 wherein said platform member further comprises a palette means carried between opposite sides of said work table.

13. The invention as defined in claim 12. Wherein said palette means comprises a roll of paint impervious material with a portion clamped to the platform whereby said clamped portion can be selectively replaced with an unused portion from the roll.

14. The invention as defined in claim 9 wherein said platform is translatable relative to the storage compartment for allowing access to at least a portion of the storage compartment.

* * * * *